US010360868B2

(12) United States Patent
Liu

(10) Patent No.: US 10,360,868 B2
(45) Date of Patent: Jul. 23, 2019

(54) IMAGE PROCESSING METHOD AND LIQUID CRYSTAL DISPLAY DEVICE

(71) Applicants: HISENSE ELECTRIC CO., LTD., Shandong (CN); HISENSE USA CORPORATION, Suwanee, GA (US); HISENSE INTERNATIONAL CO., LTD., Shandong (CN)

(72) Inventor: Yiyin Liu, Shandong (CN)

(73) Assignees: HISENSE ELECTRIC CO., LTD., Shandong (CN); HISENSE USA CORPORATION, Suwanee, GA (US); HISENSE INTERNATIONAL CO., LTD., Shandong (CN)

( * ) Notice: Subject to any disclaimer, the term of this patent is extended or adjusted under 35 U.S.C. 154(b) by 308 days.

(21) Appl. No.: 15/277,603

(22) Filed: Sep. 27, 2016

(65) Prior Publication Data

US 2017/0018231 A1 Jan. 19, 2017

(30) Foreign Application Priority Data

Dec. 9, 2015 (CN) ..... 2015 1 0899801
Dec. 9, 2015 (CN) ..... 2015 1 0902188
Dec. 9, 2015 (CN) ..... 2015 1 0902213

(51) Int. Cl.
*G09G 3/34* (2006.01)
*G09G 3/36* (2006.01)

(52) U.S. Cl.
CPC ..... *G09G 3/3688* (2013.01); *G09G 3/3426* (2013.01); *G09G 3/3648* (2013.01);
(Continued)

(58) Field of Classification Search
CPC ... G09G 2310/0232; G09G 2320/0242; G09G 2320/0646; G09G 2320/0673;
(Continued)

(56) References Cited

U.S. PATENT DOCUMENTS

2004/0257329 A1* 12/2004 Park ..... G09G 3/3406 345/102
2009/0115718 A1* 5/2009 Qiao ..... G09G 3/3426 345/102
(Continued)

FOREIGN PATENT DOCUMENTS

CN 101625843 A 1/2010
CN 102355561 A 2/2012
(Continued)

OTHER PUBLICATIONS

Office Action issued in counterpart Chinese Application No. 201510902213.8 dated May 27, 2017, its English-language translation, and associated Search Report.
(Continued)

*Primary Examiner* — Richard J Hong
(74) *Attorney, Agent, or Firm* — Brinks Gilson & Lione

(57) ABSTRACT

Embodiments of the application provide an image processing method and apparatus, and a liquid crystal display device, and relate to the field of image processing, where backlight values in respective backlight zones are determined as a function of values of grayscale brightness in a displayed image, display values in sub-pixels in a display zone corresponding to a target backlight zone are compensated for according to the result of comparing the backlight value in the target backlight zone with the weighted average of the backlight values in the other backlight zones.

15 Claims, 8 Drawing Sheets

(52) U.S. Cl.
CPC ..... *G09G 2310/0232* (2013.01); *G09G 2320/0242* (2013.01); *G09G 2320/0646* (2013.01); *G09G 2320/0673* (2013.01); *G09G 2320/0686* (2013.01)

(58) Field of Classification Search
CPC ..... G09G 2320/0686; G09G 3/3426; G09G 3/3648; G09G 3/3688; G09G 3/3413; G09G 3/3406; G02F 1/133611; G02F 1/133603
See application file for complete search history.

(56) References Cited

U.S. PATENT DOCUMENTS

| | | | | |
|---|---|---|---|---|
| 2009/0251400 | A1* | 10/2009 | Liu | G09G 3/3426 345/102 |
| 2010/0020005 | A1* | 1/2010 | Jung | G09G 3/3426 345/102 |
| 2010/0283802 | A1* | 11/2010 | Jung | G09G 3/3426 345/690 |
| 2014/0204007 | A1 | 7/2014 | Peana | |
| 2015/0029237 | A1* | 1/2015 | Chen | G09G 3/3413 345/690 |
| 2016/0225323 | A1* | 8/2016 | Lu | G09G 3/3406 |
| 2017/0061901 | A1 | 3/2017 | Zhang et al. | |
| 2017/0365225 | A1* | 12/2017 | Yoneyama | G02F 1/133603 |
| 2018/0174534 | A1* | 6/2018 | Ninan | G02F 1/133611 |

FOREIGN PATENT DOCUMENTS

| | | | |
|---|---|---|---|
| CN | 102460552 | A | 5/2012 |
| CN | 102622990 | A | 8/2012 |
| CN | 102930831 | A | 2/2013 |
| CN | 105047142 | A | 11/2015 |
| WO | 2015148244 | A2 | 10/2015 |

OTHER PUBLICATIONS

Office Action issued in counterpart Chinese Application No. 201510902188.3 dated Apr. 21, 2017, its English-language translation, and associated Search Report.

* cited by examiner

| | | |
|---|---|---|
| Display zone 1 | Display zone 2 | Display zone 3 |
| Display zone 4 | Display zone 5 | Display zone 6 |
| Display zone 7 | Display zone 8 | Display zone 9 |

Fig.6

| | | |
|---|---|---|
| Backlight zone 1 | Backlight zone 2 | Backlight zone 3 |
| Backlight zone 4 | Backlight zone 5 | Backlight zone 6 |
| Backlight zone 7 | Backlight zone 8 | Backlight zone 9 |

Fig.7

IMAGE PROCESSING METHOD AND LIQUID CRYSTAL DISPLAY DEVICE

This application claims the benefit of Chinese Patent Application No. 201510899801.0, filed with the Chinese Patent Office on Dec. 9, 2015 and entitled "Image processing method and liquid crystal display device". No. 201510902213.8, filed with the Chinese Patent Office on Dec. 9, 2015 and entitled "Image processing method and liquid crystal display device", and No. 201510902188.3, filed with the Chinese Patent Office on Dec. 9, 2015 and entitled "Image processing method and liquid crystal display device", all of which are hereby incorporated by reference in their entireties.

FIELD

The present application relates to the field of liquid crystal displays, and particularly to an image processing method and a liquid crystal display device.

BACKGROUND

A Liquid Crystal Display (LCD) typically controls backlight brightness through dynamic backlight modulation to save energy, to improve display contract, and achieve other quality of image effects. As illustrated in FIG. 1 which is a schematic structural diagram of the principle of dynamic backlight modulation in the liquid crystal display, the liquid crystal display device includes an image processing section and an backlight processing section, where the image processing section configured to receive an input image signal, and to acquire backlight data from grayscale brightness of the image signal, on one hand, the image processing section converts the format of the image signal as per a predetermined specification of a display panel, and outputs the image signal to a timing controller (TCON) in a display section of the liquid crystal display device so that the timing controller generates a timing control signal and a data signal to drive the liquid crystal panel; and on the other hand, the image processing section outputs the acquired backlight data to the backlight processing section, and the backlight processing section converts the backlight data into a backlight control signal to control a backlight driving section to control brightness of backlight sources in a backlight component, so that if the brightness of an image on the liquid crystal panel is higher, then the backlight sources will be driven for higher backlight brightness, and if the brightness of the image is lower, then the backlight sources will be driven for lower backlight brightness.

Dynamic backlight modulation generally includes zoned backlight modulation and global backlight modulation, where in global backlight modulation, the backlight brightness is controlled by acquiring the average brightness over one frame of image so that the global backlight modulation may not significantly improve the quality of picture effect for the display contrast.

In zoned dynamic backlight modulation as illustrated in FIG. 2 which is a schematic diagram of backlight zones in zoned dynamic backlight modulation in the prior art, the entire matrix of backlight sources includes M zones in the direction A, and N zones in the direction B, and as illustrated, if M=16 and N=9, then there will be M*N=144 backlight zones in total, in each of which the backlight source brightness can be controlled individually as a result of driving, so that the backlight brightness of the backlight zones will be determined by the brightness of the image blocks corresponding to the backlight zones, and the variations in backlight brightness of the zones will reflect the grayscale brightness in the zone image data blocks in which area pictures need to be displayed, and highlight the differences in display brightness between the partial pictures of the displayed image, thus improving the contrast quality-of-picture effect of the dynamic image.

The information disclosed above is only disclosed for complementing understanding, and is not determined as or claimed as prior art of the present application.

SUMMARY

Some embodiment of the application provides an image processing method applicable to a liquid crystal display device including display zones and backlight zones, wherein the method includes: obtaining, by the liquid crystal display device, backlight values in respective backlight zones as a function of values of grayscale brightness of a displayed image; comparing, by the liquid crystal display device, the backlight value in a target backlight zone with the weighted average of the backlight values in the other backlight zones; and compensating, by the liquid crystal display device, for values of color levels for display data in sub-pixels in a display zone corresponding to the target backlight zone according to a result of comparison.

Some embodiments of the application provides a liquid crystal display device including: a timing controller configured to receive externally input displayed image data, and to extract a timing signal and an image data signal; a gate driving circuit configured to receive the timing signal to drive gate scanning; a data driving circuit configured to receive the timing signal and the image data signal to drive data electrodes for data scanning, wherein the data driving circuit digital-to-analog converts the image data signal into pixel voltage values configured to drive TFT data electrodes in sub-pixels respectively; a backlight comparing section configured to compare the backlight value in a target backlight zone with the backlight values in the other backlight zones; and to compensate for values of color levels for display data in the sub-pixels in a display zone corresponding to the target backlight zone according to a result of comparison; and a reference voltage generating section configured to generate pixel voltage corresponding to the compensated values of color levels.

Some embodiments of the application provides a liquid crystal display device including a memory and at least one processor, the memory stores therein instructions executable by the at least one processor are stored, and the instructions are configured to be executed by the at least one processor to cause the at least one processor to be capable of: obtaining backlight values in respective backlight zones as a function of values of grayscale brightness of a displayed image; comparing the backlight value in a target backlight zone with the weighted average of the backlight values in the other backlight zones; and compensating for values of color levels for display data in sub-pixels in a display zone corresponding to the target backlight zone according to a result of comparison.

BRIEF DESCRIPTION OF THE DRAWINGS

In order to make the technical solutions according to the embodiments of the application more apparent, the drawings to which a description of the embodiments or the prior art refers will be briefly introduced below, and apparently the drawings to be described below are merely illustrative of some of the embodiments of the application, and those ordinarily skilled in the art can derive from these drawings other drawings without any inventive effort. In the drawings:

FIG. 6 illustrates a schematic diagram of display zones into which a display screen of the liquid crystal display device is divided:

FIG. 7 illustrates a schematic diagram of backlight zones corresponding to the display zones in FIG. 6;

DETAILED DESCRIPTION OF THE EMBODIMENTS

The technical solutions according to the embodiments of the application will be described below clearly and fully with reference to the drawings in the embodiments of the application, and apparently the embodiments described below are only a part but not all of the embodiments of the application. Based upon the embodiments here of the application, all the other embodiments which can occur to those skilled in the art without any inventive effort shall fall into the scope of the application.

The inventors have identified that with the use of the quantum film in dynamic zoned backlight control, the image is displayed in the respective backlight zones in their corresponding colors with such partial chromatic aberrations that are random instead of being generally regular. For example, if the image is displayed in white in a central area, then the image may be displayed in edge areas around the central area in bluishness. The inventors have lowered the power of the blue light emitting chip to thereby address the problem of being bluish at the edges, that is, to weaken the blue light component, so that the image can be alleviated from being displayed in bluishness at the edges around the central area. However the image may be displayed in the central area in yellowishness, that is, there are excessive green light and red light components in the central area.

The inventors have identified as a result of a preliminary analysis that the problem of chromatic aberration occurs given the same power of the blue light sources directly due to the non-uniform proportion of the quantum dot material distributed in the quantum dot film, that is, if the image is displayed purely in white in the central area, and in bluishness around the central area, then the proportion of the quantum dot material distributed in the central area of the quantum dot film will well match the blue light rays, and the proportion of the quantum dot material distributed around the central area of the quantum dot film will be relatively low, so that there may be such an excessive blue light ray component around the central area that the image is displayed in bluishness around the central area. Thus the inventors have identified as a result of a further analysis of the proportion of the quantum dot material distributed in the respective areas of the quantum dot film that the proportion of the quantum dot material distributed in the quantum dot film is very uniform without the problem above.

Figure 1:
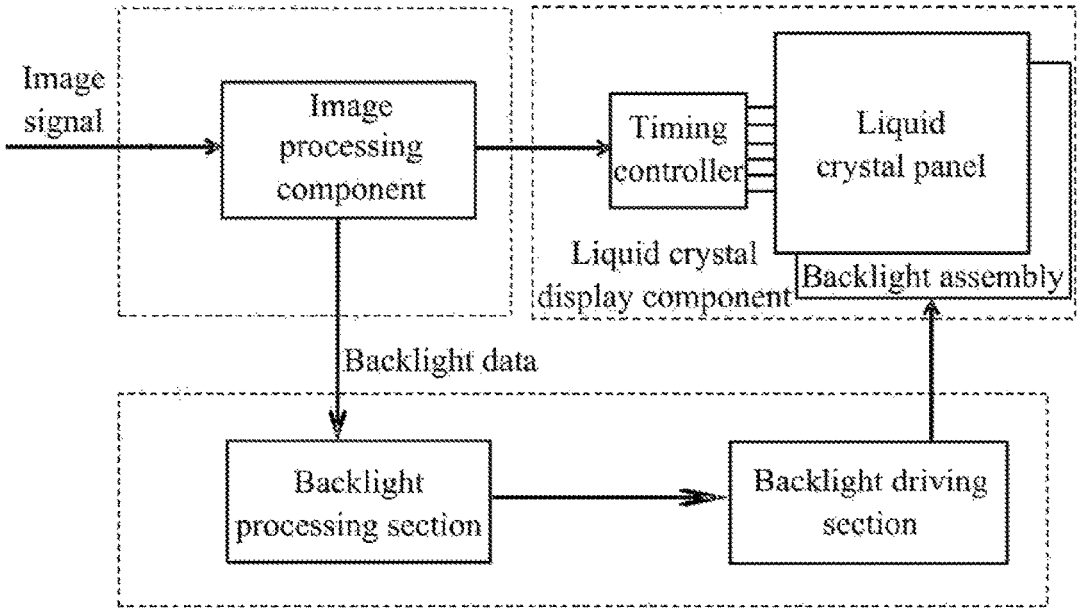
FIG. 1 illustrates a schematic diagram of the all-white picture displayed on the liquid crystal display.
Figure 2:
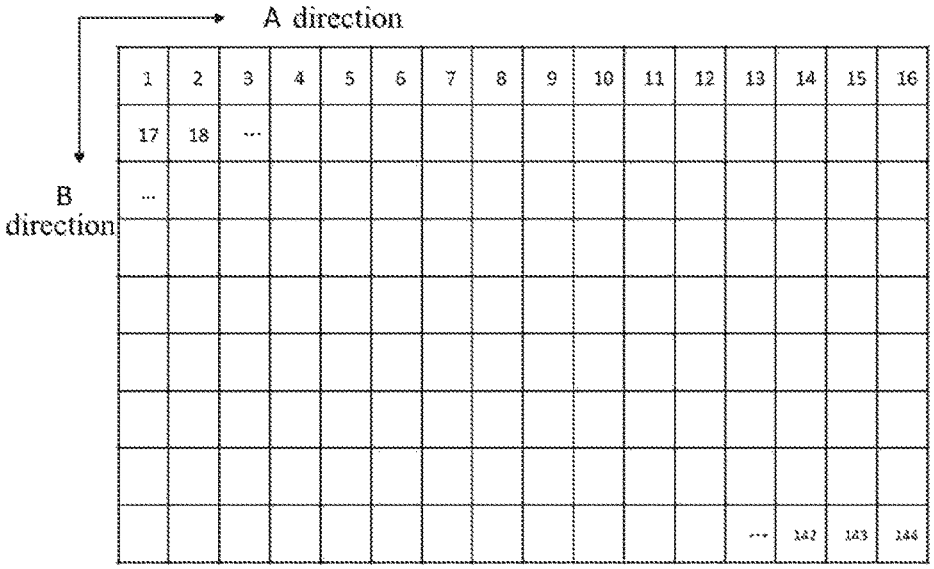
FIG. 2 illustrates a schematic diagram of light rays in the display zones of the all-white picture displayed on the liquid crystal display.
Figure 3:
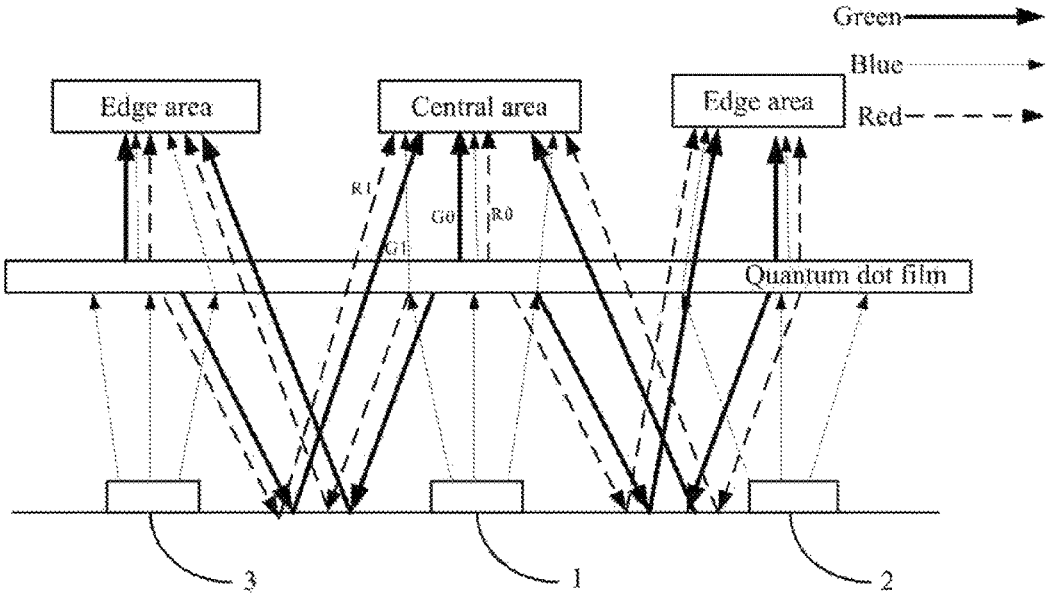
FIG. 3 illustrates a schematic diagram of an analysis of the reason for the chromatic aberration in the liquid crystal display device.

In the phenomenon of partial chromatic aberration above, the image is displayed purely in white in the central area, and in bluishness around the central area, and the inventors have preliminarily identified that the reason for this phenomenon shall be related to the position of the display area. The inventors have identified as a result of a further analysis that if the proportion of the quantum dot material distributed in the quantum dot film is uniform, and the power of the blue light emitting chip in each backlight zone is also the same, then as illustrated in FIG. 3 which is a schematic diagram of an analysis of the reason for the chromatic aberration in the liquid crystal display device, the white light sources will operate in such a way that the blue light is emitted by the LED light emitting chips 1, 2 and 3 to excite the quantum dot material in the quantum dot film so that the blue light and the red light are emitted by the quantum dot film, and mixed uniformly with the blue light transmitted through the quantum dot film into the white light. However if the image is displayed purely in white in both the central area and the edge areas around the central area, then all the LED chip in the central area, and the LED chips in the edge areas will be driven at transmit power of 100%; and of the white light source in the central area, one part thereof operate in such a way that the quantum dot material is excited by the blue LED light emitting chip 1 in the central area to generate the forward green light G0 and the forward red light R0 so that the forward green light G0 and the forward red light R0 is mixed with the transmitted blue light into the white light, and the other part thereof operate in such a way that the quantum dot material is excited by the blue LED light emitting chips 2 and 3 in the edge areas around the central area to generate the backward green light G1 and the backward red light R1 so that the backward green light G1 and the backward red light R1 is reflected into the central area, and mixed with the blue light transmitted by the blue LED light emitting chip 1 in the central area through the quantum dot film into the white light. However although these two parts of green light and red light are mixed with the transmitted blue light into the white light, less reflected green light and red light is received in the edge areas around the central area than in the central area, and the transmitted blue light component remains the same in the edge areas as in the central area, so that there is an excessive blue light component in the white light in the edge areas around the central area after the respective light components are mixed therein, thus resulting in bluishness. However the inventors have identified that if another image is displayed, for example, the image is displayed purely in white in the central area, and at lower brightness in the edge areas around the central area, then the image will be also displayed in bluish in the central area, but less bluish in the edge areas around the central area, so the inventors have identified that the phenomenon of chromatic aberration is not directly related to the position of the display area.

As a result, the inventors have identified as a result of a number of analysis, experiments, and comparisons such regularity of the partial chromatic aberration above that the chromatic aberration is primarily related directly to the difference in light emission brightness of the LED light emitting chips in the adjacent backlight zones, where if the image is displayed at the same brightness in each zone, then the phenomenon of partial chromatic aberration will not occur; and if there is a difference in display brightness between the respective edge areas, that is, there is different backlight brightness in the respective adjacent backlight zones in the liquid crystal display device operating with dynamic zoned backlight control, then the phenomenon of partial chromatic aberration will occur in the adjacent display zones. The inventors have further identified from the regularity of chromatic aberration above the reason for the chromatic aberration as illustrated in FIG. 3, where if the image is displayed in the central area at the same brightness as in the edge areas, that is, their corresponding backlight brightness is also the same, then there will be such two white backlight components in the central area that the light is emitted by the LED chip 1 to excite the quantum dots in the central area to thereby generate the green light and the red light so that the green light and the red light is mixed with the transmitted blue light into the white light, and the light is emitted by the LED chip 2 and the LED chip 3 in the edge areas to excite the quantum dots to thereby generate the backward green light and the backward red light so that the backward green light and the backward red light is mixed with the blue light transmitted by the LED chip 1 into the white light. However if the image is still displayed purely in white in the central area, and at lower brightness in the edge areas around the central area, then the driven backlight brightness corresponding to the brightness of the all-white image in the central area will be 100%, that is, the LED chip 1 will be driven at transmit power of 100%, and the LED chips 2 and 3 in the edge areas around the central area will be driven at lower transmit power, so that there will be less green light and red light components reflected from the edge areas around the central area in the white light in the central area, thus resulting in bluishness in the central area, and there will be more backward green light and red light components generated by the LED chip 1, thus resulting in yellowish in the edge areas around the central area. In another example, if the image is displayed at lower brightness in the central area, and at higher brightness in the edge areas around the central area, then the LED chip 1 will emit light at lower brightness than the LED chips 2 and 3 in the edge areas around the central area, so that there will be excessive backward green light and red light components excited by the LED chips 2 and 3 in the edge areas around the central area, and then reflected into the central area in the white backlight in the central area, thus resulting in yellowishness of the image displayed in the central area, and there will be less backward green light and red light from the LED chips in the brighter areas around the central area, thus resulting in bluishness in the brighter display areas around the central area.

The liquid crystal display device operates with dynamic backlight control under such a general principle that the brightness of the backlight sources in the backlight zones is controlled as a function of the brightness of the image in the corresponding display zones so that the brightness of the backlight sources in the respective zones varies randomly with the brightness of the image. As can be apparent from the analysis above, there is such regularity that the image may become bluish in the area where the LED chip emits light at higher brightness, and yellowish in the area where the LED chip emits light at lower brightness, and in order to address the problem of random partial chromatic aberration arising from the difference in backlight brightness, the inventors firstly have conceived such a solution that the problem of bluishness is alleviated by reducing the difference in power between the LED chips, which apparently contradicts the general principle of dynamic backlight control. Thus if the backlight sources are provided using the quantum dot film, then the problem of random partial chromatic aberration in the displayed image will be inevitable, so that it is desirable for those skilled in the art to address the problem of random partial chromatic aberration arising from the difference in backlight brightness.

Further to the analysis above by the inventors with their inventive efforts, in the liquid crystal display device operating with dynamic backlight control, the brightness of the light source in each backlight zone is determined by the overall value of grayscale brightness in the image displayed in the display area corresponding to the backlight zone so that if the grayscale brightness thereof is higher, than the backlight source in the backlight zone will be driven at higher brightness, there will be more backward green light and red light generated by the quantum dots in the quantum dot film excited by the blue LED light emitting chip of the backlight source in the backlight zone, and there will be an influence thereof upon the color components in the edge areas. Following the analysis above, the inventors have proposed such a solution with their inventive efforts that the grayscale brightness of the image in each display zone is statistically analyzed, and voltage values of respective pixels in the zone are compensated for according to the difference in grayscale brightness to thereby alleviate the problem of chromatic aberration in the image arising from the chromatic aberration of backlight so as to address the problem of random partial chromatic aberration in the displayed image.

Figure 9:
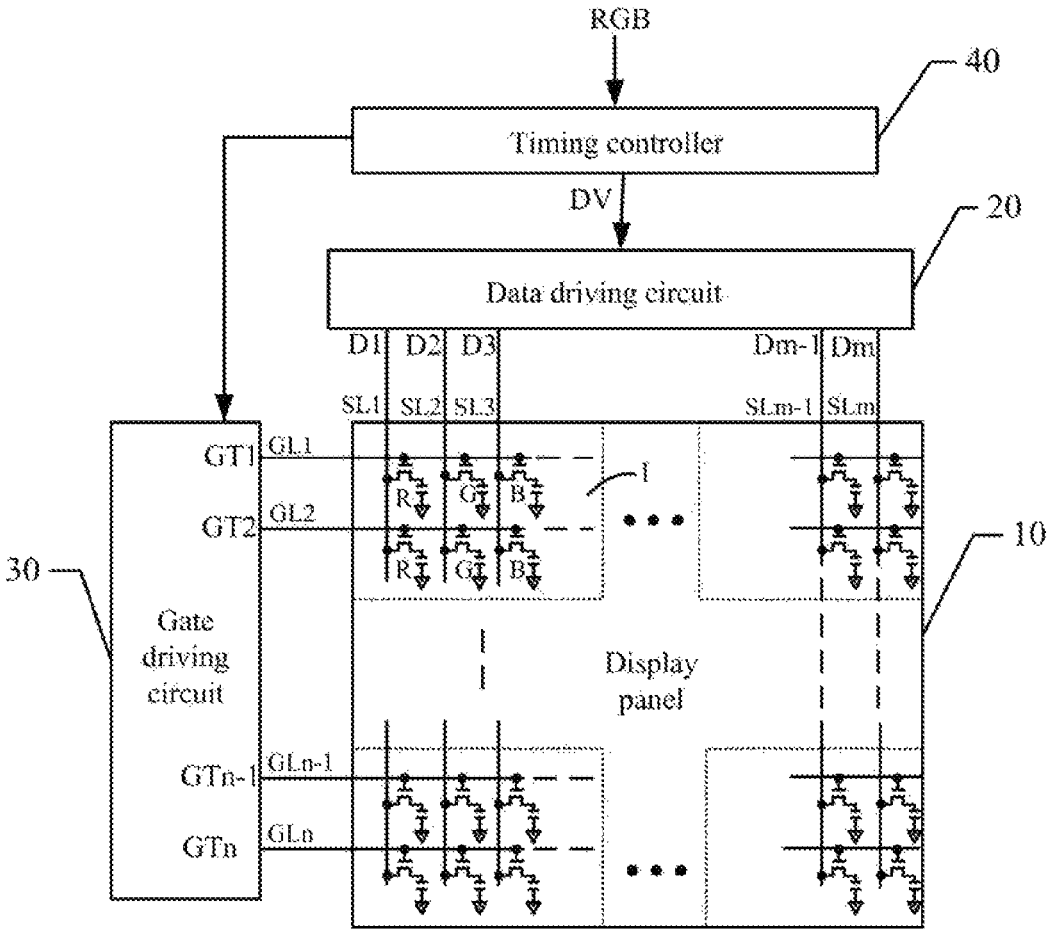
FIG. 9 is a schematic structural diagram of pixel voltage compensation circuit in a liquid crystal display device according to some embodiments of the application.

FIG. 9 illustrates a schematic structural diagram of pixel voltage compensation circuit in the liquid crystal display device according to the embodiment of some applications. As illustrated in FIG. 9, a timing controller (TCON) 40 receives externally input RGB display image data, and extracts a timing signal and an image data signal, where the timing signal is provided respectively to a data driving circuit 20 and a gate driving circuit 30 to scan the matrix synchronously, and the image data signal is provided to the data driving circuit 20 for digital to analog conversion into pixel voltage values $D_1$-$D_m$ for driving TFT data electrodes in liquid crystal pixel elements respectively. In some applications, pixel voltage values of respective sub-pixels R (red), G (green), and B (blue) in the respective zones are compensated for according to the differences in grayscale brightness of the image in the respective adjacent backlight zones to thereby alleviate the problem of chromatic aberration in the white light sources in the respective backlight zones.

As illustrated in FIG. 9, if the value of grayscale brightness of an image in a display zone 1 is more than the value of grayscale brightness of the image in display zones around the display zone 1, then the proportion of backward red and green light in the display zone 1 from backlight zones around a backlight zone corresponding to the display zone 1, in a backlight source in the backlight zone will be smaller than the proportion of the backward red and green light if the grayscale brightness of the image in the display zone is less than the grayscale brightness of the image in the display zones around the display zone 1, so pixel voltage values $D_1$ of sub-pixels R, and pixel voltage values $D_2$ of sub-pixels G in the display zone 1 can be raised by the same factor, or pixel voltage values $D_3$ of sub-pixels B in the display zone 1 can be lowered, to thereby alleviate the problem of chromatic aberration in the displayed image arising from inconsistent chromatic aberrations in mixing the colors of the backlight sources.

Here the grayscale brightness of the image in the display zones around the display zone 1 is determined as a function of weights of an influence of all the backlight zones around the backlight zone corresponding to the display zone 1 upon the backlight brightness in the display zone 1. For example, the grayscale brightness of the image in the display zones around the display zone 1 is the sum of the products of the values of grayscale brightness in the respective zones around the display zone 1, and their weight coefficients, where the weight coefficients are determined as a function of the distance between the respective zones and the target display zone in such a way that there is a smaller weight coefficient of a display zone at a longer distance from, and thus with a smaller influence upon the target display zone. The weight coefficient can be determined by experimentally measuring in advance the amplitude of an influence of each display zone upon the brightness in the target display zone, or determined in proportion to the distance.

In the liquid crystal display device operating with separate zoned backlight control where the white backlight sources operates as a result of the quantum dot film being excited by the monochromatic light emitting chips, the control signals are generated as a function of the grayscale brightness of the image displayed in the respective display zones to control the brightness of the backlight sources in the display zones, so that there will be higher brightness of the backlight sources in the backlight zones corresponding to the display zones in which the image is displayed at higher grayscale brightness, so the backlight brightness in the respective backlight zones varies randomly so that there will be also different proportions of the backward light from the surrounding backlight zones in mixing the light of the backlight sources in the respective backlight zones, to the forward light in the backlight zones; and since there is only backward red and green light to be mixed, and the proportion of the forward red, green, and blue light to be mixed is predetermined, it may be difficult for the white light into which the forward light and the backward light is mixed to be consistent. In order to address this problem, in the application, the pixel voltage values of the sub-pixels R, and the pixel voltage values of the sub-pixels G in the display zones are adjusted by the same factor, or the pixel voltage values of the sub-pixels B are adjusted, to thereby alleviate the influence of the varying proportion of the backward light to be mixed into the white light. Here as can be apparent from the analysis above, the proportion of the backward light components to be mixed into the white light is determined as a function of the difference in backlight brightness between the backlight zone, and the backlight zones around the backlight zone, so both the pixel voltage values of the red sub-pixels and the green sub-pixels, or the pixel voltage values of the blue sub-pixels in the display zone can be adjusted according to the difference in backlight brightness to thereby alleviate the problem of chromatic aberration in the displayed image due to the backward light.

First Embodiment

Figure 4:
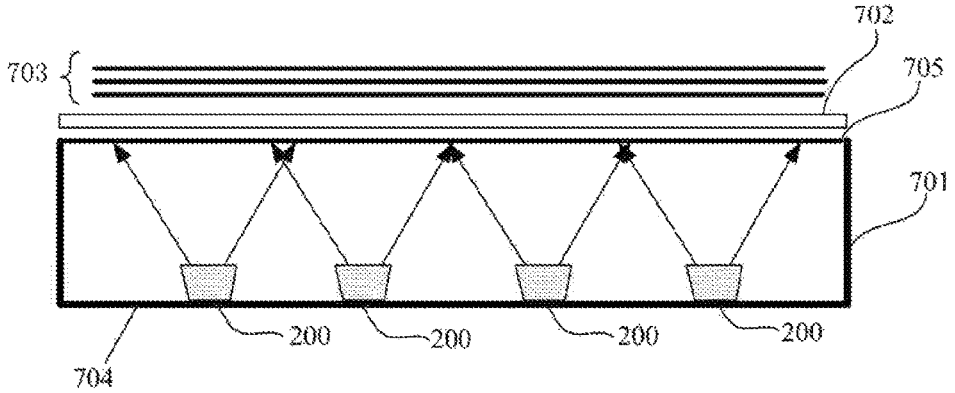
FIG. 4 illustrates a liquid crystal display device according to some embodiments of the application.

Some embodiments of the application provides an image processing method applicable to a liquid crystal display device including backlight sources provided using quantum dots. As illustrated in FIG. 4 showing a liquid crystal display device including backlight sources provided by a direct-light-type backlight module to which light is incident immediately straight, a number of spot light sources 200 are arranged on an inner surface of a bottom board 704 of a back encapsulating structure 701 (backboard) of the backlight module, where the spot light sources 200 can be blue LED lamps; and a quantum dot material encapsulating section 702 is located in a light exit direction of the spot light sources 200, where in order to guarantee thermal isolation performance of a quantum dot material, and to sufficiently mix light emitted by the spot light sources 200, there will be some thermal isolation gap and light mixing distance between the quantum dot material encapsulating section 702 and the spot light sources 200, where the exciting light (e.g., blue light) emitted by the spot light sources 200 is sufficiently mixed into uniform exciting surface light sources; and then the exciting surface light sources excite the quantum dot material in the light exit direction to generate excited light so that the excited light is mixed into mixed light and/or the excited light is mixed into the transmitted exciting light into white light sources; and the quantum dot material is encapsulated in the quantum dot material encapsulating section 702, where the quantum dot material encapsulating section 702 can be composed of encapsulating quantum dots in the scattering board, can be composed of encapsulating quantum dots in an optical film sheet, or can be embodied in other encapsulating optical structures. If the spot light sources 200 emit the exciting light to excite the quantum dot material encapsulating section 702 respectively, then there will be backward excited light (e.g., backward green light and red light) generated respectively by the excited quantum dots in the respective spot light sources, and the backward excited light will become optical components of white light in edge areas, so that their intensity will influence upon the white color in the edge areas, and in order to alleviate the mutual influence between them, the influence of the backward excited light upon the edge areas of a backlight zone shall be alleviated.

In the liquid crystal display device operating with dynamic zoned back control, a displayed image is zoned in correspondence to zones of backlight sources, grayscale brightness of the image in the display zones is counted, and the values of grayscale brightness in the display zones of the image are converted into drive signals to drive the backlight sources, that is, if the average grayscale brightness in a display zone of the image is higher, then the grayscale brightness will be converted into a backlight drive signal to drive a backlight source in a backlight zone corresponding to the display zone at higher brightness.

Figure 8:
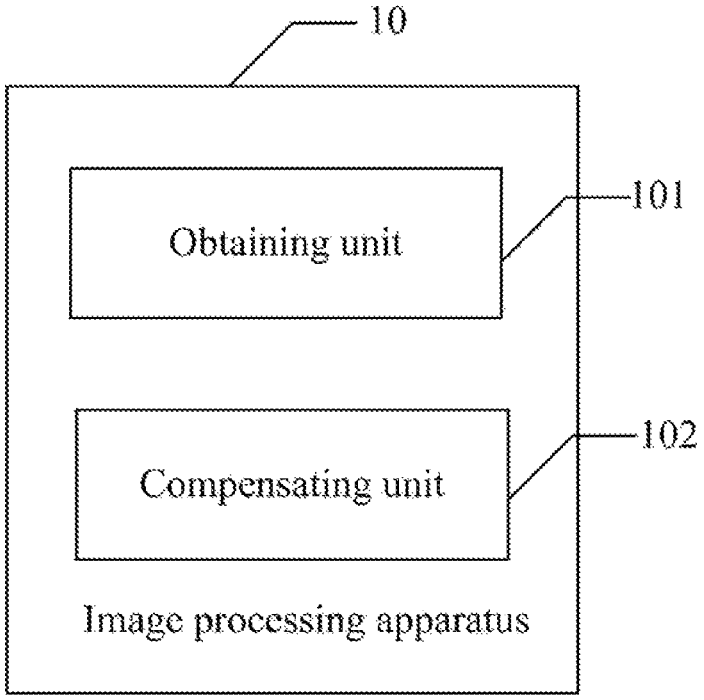
FIG. 8 illustrates a schematic diagram of an image processing apparatus according to some embodiments of the application.

It shall be noted those ordinarily skilled in the art can configure the numbers of quantum dots in the quantum dot material encapsulating section 702 to generate red light, green light, and blue light for generation of white light so that pure white light sources can be generated given the same backlight brightness in the respective backlight zones. In order to address the problem of partial chromatic aberration in the display zones arising from the brightness in the different backlight zones varying with the brightness of the image in the display zones in dynamic zoned backlight control, the liquid crystal display device according to this embodiment further includes an image processing apparatus which can be one or more video processing chips, or which can perform a part of functions in the video processing chip. FIG. 8 illustrates a schematic diagram of an image processing apparatus according to some embodiments of the application applicable to a liquid crystal display device, where the apparatus 10 includes an obtaining unit 101 and a compensating unit 102.

Figure 5:
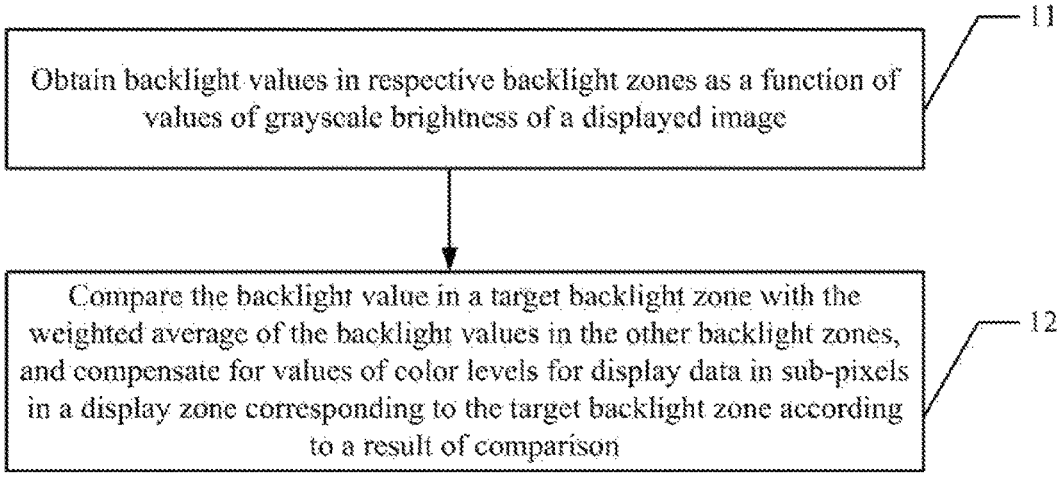
FIG. 5 illustrates a schematic flow chart of an image processing method according to a first embodiment of the application.

Some embodiments of the application provides an image processing method, and FIG. 5 illustrates a schematic flow chart of this method.

In some embodiments of the application, the apparatus as illustrated in FIG. 8 can perform the processing flow of the method as illustrated in FIG. 5, the obtaining unit 101 executes program of the step 11 in the image processing method, and the compensating unit 102 executes program of the step 12 in the image processing method.

The processing flow illustrated in FIG. 5 includes the step 11 of obtaining backlight values in respective backlight zones as a function of values of grayscale brightness of a displayed image, where the backlight values are configured to drive separately the brightness of backlight sources in the respective backlight zones, the backlight sources in the respective backlight zones can be composed of single or multiple dot light sources, e.g., LED light emitting chips, the brightness of the backlight sources in the respective backlight zones is controlled individually, and the magnitude of the brightness of the backlight source in each backlight zone is determined as a function of grayscale brightness of the image in a display zone to which the backlight zone is mapped.

By way of an example, a CPU processing chip receives an input video image signal, acquires values of grayscale brightness in respective image zones from the video image signal respectively under a predetermined image zoning rule, where the grayscale brightness can be an average or a weighted average, and then outputs the acquired values of grayscale brightness to a backlight processing section, and the backlight processing section converts the values of grayscale brightness into backlight control signals to control backlight driving sections to control brightness of all the backlight sources in the backlight zones. By way of an example, there may be one or more spot light sources, e.g., LED light emitting chips, in a backlight zone, and if the brightness of the image in the zone is higher, then higher brightness of an exciting spot light source in the backlight zone will be driven, and if the brightness of the image in the zone is lower, then lower brightness of the exciting spot light source in the backlight zone will be driven; or alternatively the format of the image signal can be converted as per a predetermined specification of a display panel, and the image signal can be output to a timing controller (TCON) in a liquid crystal display section so that the timing controller generates a timing control signal and a data signal to drive the liquid crystal panel.

It shall be noted that red grayscale values, green grayscale values, and blue gravscale values can be converted into brightness grayscale value Y components among the values of grayscale brightness in a YUV color space. By way of an example, the CPU chip in the liquid crystal display device receives and decodes the image video signal into an RGB signal, and transmits the RGB signal to a video processing algorithm chip via Low-Voltage Differential Signaling (LVDS), and the video processing algorithm chip firstly converts the RGB signal into a YUV signal including a brightness component Y value in each pixel, counts the brightness component values of the respective pixels in each display zone under a predetermined display zoning rule, and converts the brightness component value in the display zone into the backlight value in the backlight zone in a predetermined algorithm, where the backlight value in the backlight zone is configured to drive the brightness of the backlight source in the backlight zone. Many algorithms for converting a brightness component into a zone backlight value can occur to those skilled in the art, so a repeated description thereof will be omitted here.

The values of grayscale brightness can alternatively be determined by determining the sums of grayscale values of all the red pixels in each respective display zone, determining the average grayscale values of all the red pixels in the display zone from the sums of grayscale values of all the red pixels in the display zone, and determining the weighted averages of the average grayscale values of all the red pixels in the display zone, and the largest grayscale values of all the red pixels in the display zone as the red grayscale values in the display zone, and similarly determining the green grayscale values and the blue grayscale values in each display zones; converting the red grayscale values, the green grayscale values, and the blue grayscale values in the display zone into the values of brightness grayscale in the display zone, and converting the values of brightness grayscale into the backlight values in the backlight zone.

It shall be noted that the display area can be divided into the display zones corresponding to the backlight zones, and the backlight area can be divided into the backlight zones of backlight sources, where each individually controlled backlight source is a backlight zone, and each of the display zones typically corresponds to one of the backlight zones. The display area can alternatively be divided into the display zones for an image displayed on the real liquid crystal display, so a part of the backlight area corresponding to each of the display zones will be a backlight zone. There may be one or more backlight spot light sources in each backlight zone, where the spot light source is a single LED light emitting chip, for example.

If the liquid crystal display includes 9 display zones and 9 backlight zones, then each of the display zones will correspond to one of the backlight zones. As illustrated in FIG. 6 which is a schematic diagram of the display screen in the liquid crystal display device divided into display zones, for example, if the display area is divided into 9 display zones including a display zone 1, a display zone 2, a display zone 3, a display zone 4, a display zone 5, a display zone 6, a display zone 7, a display zone 8, and a display zone 9, then as illustrated in FIG. 7 which is a schematic diagram of the backlight area divided into display zones corresponding to the display zones in FIG. 6, the corresponding backlight sources will also be divided into 9 backlight zones including a backlight zone 1, a backlight zone 2, a backlight zone 3, a backlight zone 4, a backlight zone 5, a backlight zone 6, a backlight zone 7, a backlight zone 8, and a backlight zone 9. A value of grayscale brightness in the display zone 1 is converted into a backlight value in the backlight zone 1, for example, if the value of grayscale brightness in the display zone 1 is the grayscale of 255, and the backlight value in the backlight zone 1 is 255, then the value of 255 can be converted into a PWM backlight control signal or a electric current control signal to control the brightness of the backlight source, or the value 255 of grayscale brightness can be further converted algorithmically into a backlight value, and the resulting backlight value can be further converted into a PWM backlight control signal or a current control signal to control the brightness of the backlight source.

The step 12 is to compare the backlight value in a target backlight zone with the weighted average of the backlight values in the other backlight zones, and to compensate for values of color levels for display data in sub-pixels in a display zone corresponding to the target backlight zone according to a result of comparison.

Here the other backlight zones can be adjacent backlight zones to the target backlight zone, or can be backlight zones at some distance from the target backlight zone.

The grayscales of the compensated display data are converted into pixel voltage values to drive TFT data electrodes in the respective sub-pixel elements on the display panel to thereby alleviate the problem of chromatic aberration in the display image arising from chromatic aberrations in the backlight sources for the respective display zones.

Particularly the backlight value in the target backlight zone can be compared with the weighted average of the backlight values in the other backlight zones in any one of the following first approach to third approach.

In a first approach, the backlight value in the target backlight zone can be compared with the weighted average of the backlight values in the other backlight zones to thereby determine whether the former is more or less than the latter so that values of color levels for the display data are compensated for accordingly.

For example, if the backlight value in the target backlight zone is more than the weighted average of the backlight values in the other backlight zones, then the values of color levels for the display data in all the red and green sub-pixels in the display zone corresponding to the target backlight zone can be raised, or the values of color levels for the display data in all the blue sub-pixels in the target display zone can be lowered.

Alike if the backlight value in the target backlight zone is less than the weighted average of the backlight values in the other backlight zones, then the values of color levels for the display data in all the red and green sub-pixels in the display zone corresponding to the target backlight zone can be lowered, or the values of color levels for the display data in all the blue sub-pixels in the target display zone can be raised.

If the values of color levels for the display data in the red and green sub-pixels in the display zone corresponding to the target backlight zone are compensated for, then the values of color levels for the display data in all the red and green sub-pixels in the display zone will be compensated for by the same factor, and if the values of color levels for the display data in the blue sub-pixels in the display zone corresponding to the target backlight zone are compensated for, then the values of color levels for the display data in all the blue sub-pixels in the display zone will be compensated for by the same factor.

In a second approach, the ratio of the backlight value in the target backlight zone to the weighted average of the backlight values in the other backlight zones can be determined so that values of color levels for the display data are compensated for accordingly.

The difference between the backlight value in the target backlight zone, and the weighted average of the backlight values in the other backlight zones, and the ratio of the difference to the backlight value in the target backlight zone are determined, the products of a predetermined compensation factor corresponding to the ratio, and the values of color levels in the sub-pixels in the display zone corresponding to the target backlight zone are determined as values of color levels to be compensated for the display data in the sub-pixels in the display zone corresponding to the target backlight zone, and the determined values of color levels to be compensated are added to the values of color levels in the display zone corresponding to the target backlight zone.

By way of an example, if the backlight value in the target backlight zone 5 is 255, and the weighted average of the backlight values in the other backlight zones is 200, then the difference between the backlight value in the target backlight zone 5, and the weighted average of the backlight values in the other backlight zones will be 55, and the display values of all the red and green sub-pixels in the display zone 5 will be compensated by a particular factor which can be retrieved by searching a preset data table, or which can be otherwise calculated. Those skilled in the art shall calculate the factor in a calculation equation particularly taking into account the proportion of reflected light rays in the particular backlight zone from the adjacent backlight zones. For example, if the ratio is 55/255, and a backlight influence coefficient of the adjacent backlight zones is 10%, then the compensation factor will be (55/255)*10%=2.1%, so that the values of color levels for the display data in all the red and green sub-pixels in the display zone 5 will be raised by the same factor of 2.1%.

In a third approach, a preset correspondence relationship between the backlight value in the target backlight zone, and the weighted average of the backlight values in the other backlight zones can be determined so that values of color levels for the display data are compensated for accordingly.

A predetermined correspondence relationship table between the backlight value in the target backlight zone, the weighted average of the backlight values in the other backlight zones, and the compensation factor is searched for the compensation factor corresponding to the backlight value in the target backlight zone using the backlight value in the target backlight zone, and the weighted average of the backlight values in the other backlight zones, the products of the values of color levels in the sub-pixels in the display zone corresponding to the target backlight zone, and the determined compensation factor are determined as values of color levels to be compensated for the display data in the corresponding sub-pixels in the target display zone, and the determined values of color levels to be compensated are added to the values of color levels in the display zone corresponding to the target backlight zone.

The weighted average of the backlight values in the other backlight zones is determined as a function of the backlight values of a part or all of the other backlight zones than the target backlight zone multiplied with their corresponding weight coefficients. By way of an example, the backlight zone 1 is a target backlight zone, and the other backlight zones include the backlight zone 2, the backlight zone 3, the backlight zone 4, the backlight zone 5, the backlight zone 6, the backlight zone 7, the backlight zone 8, and the backlight zone 9; and in fact, if the other backlight zone 3, backlight zone 6, backlight zone 7, backlight zone 8, and backlight zone 9 far away from the backlight zone 1 have very insignificant influences on the backlight zone 1, then these other backlight zones far away from the backlight zone 1 will be excluded from the weighted average of the backlight values in the other backlight zones. Furthermore the weight coefficients of the respective backlight zones are determined by the contributions of their backlight brightness to the brightness in the target backlight zone, where there is a smaller weight coefficient of a backlight zone further away from the target backlight zone.

The weighted average of the backlight values in the other backlight zones than the target backlight zone can be experimentally determined by those skilled in the art. For example, if the backlight zone 1 is the target backlight zone, then the contribution of the backlight zone 2 to the backlight brightness in the backlight zone 1, and thus the weight coefficient thereof can be determined as a function of a variation in brightness in the backlight zone 1 with the backlight zone 2 being enabled or disabled, and alike the weight coefficients of the other backlight zones can be determined; and then the respective backlight zones can be determined as a target backlight zone, the weight coefficients of the other backlight zones can be determined respectively, the pre-stored weight coefficients of the other backlight zones than the target backlight zone can be retrieved by searching the table, and further the weighted average of the backlight values in the other backlight zones can be calculated. Alternatively the weighted average can be determined as a function of the backlight value in the target backlight zone, and the distance parameters of the other backlight zones, where there is a smaller weight coefficient of a backlight zone further away from, and thus with a smaller influence on the brightness in the target backlight zone.

In some embodiments, the backlight values in the respective backlight zones are determined as a function of the values of grayscale brightness in the displayed image, the values of color levels for the display data in the sub-pixels in the display zone corresponding to the target backlight zone are compensated for according to the result of comparing the backlight value in the target backlight zone with the weighted average of the backlight values in the other backlight zones, and the compensated values of color levels for the display data are converted into the pixel voltages to drive the pixels for displaying the image. The difference in grayscale brightness of the image displayed in the respective display zones comes with the difference in backlight brightness resulting in the problem of partial chromatic aberrations in the display zones, so the regularity of the chromatic aberration as a function of the difference in backlight brightness can be determined to thereby compensate for the values of color levels for the display data in the sub-pixels in the displayed image so as to alleviate the phenomenon of chromatic aberration.

Second Embodiment

Some embodiments provides a liquid crystal display device as illustrated in FIG. 4 including backlight sources provided by a direct-light-type backlight module, where a number of spot light sources 200 are arranged on an inner surface of a bottom board 704 of a back encapsulating structure 701 (backboard) of the backlight module, where the spot light sources 200 can be blue LED lamps; and a quantum dot material encapsulating section 702 is located in a light exit direction of the spot light sources 200, where in order to guarantee thermal isolation performance of a quantum dot material, and to sufficiently mix light emitted by the spot light sources 200, there will be some thermal isolation gap and light mixing distance between the quantum dot material encapsulating section 702 and the spot light sources 200, where the exciting light (e.g., blue light) emitted by the spot light sources 200 is sufficiently mixed into uniform exciting surface light sources; and then the exciting surface light sources excite the quantum dot material in the light exit direction to generate excited light so that the excited light is mixed into mixed light and/or the excited light is mixed into the transmitted exciting light into white light sources; and the quantum dot material is encapsulated in the quantum dot material encapsulating section 702, where the quantum dot material encapsulating section 702 can be composed of encapsulating quantum dots in the scattering board, can be composed of encapsulating quantum dots in an optical film sheet, or can be embodied in other encapsulating optical structures. In the liquid crystal display device operating with dynamic zoned backlight control, a displayed image is zoned in correspondence to zones of backlight sources, grayscale brightness of the image in the display zones is counted, and the values of grayscale brightness in the display zones of the image are converted into drive signals to drive the backlight sources, that is, if the average grayscale brightness in a display zone of the image is higher, then the grayscale brightness will be converted into a backlight drive signal to drive a backlight source in a backlight zone corresponding to the display zone at higher brightness.

Figure 10:
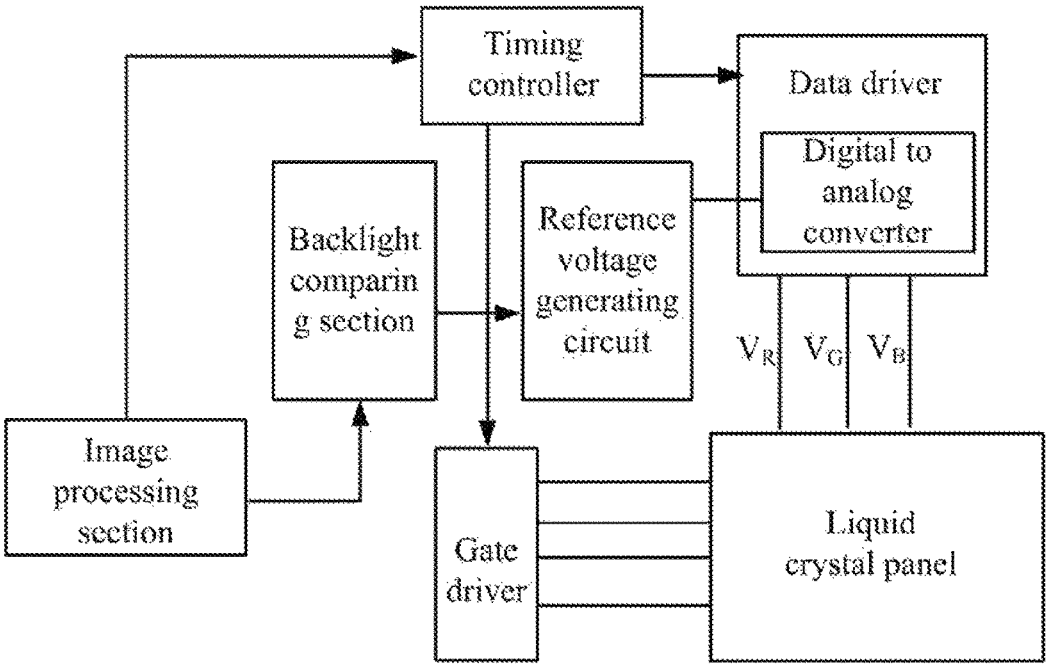
FIG. 10 illustrates a schematic structural diagram of a liquid crystal display device according to a second embodiment of the application.

As described above, in order to compensate for pixel voltage values of sub-pixels R (red), G (green), and B (blue) in the respective display zones, the liquid crystal display device as illustrated in FIG. 10 includes:

A timing controller is configured to receive externally input displayed image data, and to extract a timing signal and an image data signal:

A gate driving circuit is configured to receive the timing signal to drive gate scanning;

A data driving circuit is configured to receive the timing signal and the image data signal to drive data electrodes for data scanning, where the data driving circuit digital-to-analog converts the image data signal into pixel voltage values configured to drive TFT data electrodes in sub-pixels respectively;

An image processing section is configured to determine backlight values in the respective backlight zones as a function of values of grayscale brightness in the displayed image;

A backlight comparing section is configured to compare the backlight value in a target backlight zone with the backlight values in the other backlight zones; and to compensate for values of color levels for display data in the sub-pixels in a display zone corresponding to the target backlight zone according to a result of comparison; and A reference voltage generating section is configured to generate pixel voltage corresponding to the compensated values of color levels, e.g., reference voltage for digital to analog conversion, in order to compensate pixel voltage values of the respective sub-pixels R (red), G (green), and B (blue) in the target display zone.

Generally, a digital to analog converter is configured to convert values of color levels for display data in three colors of red, green, and blue into analog signals, and to apply the analog signals respectively to pixel voltages of respective display pixel elements through respective data lines on a liquid crystal display panel, where in order to make the values of color levels for the display data consistent with the displayed image reflected subjectively by applying an electric field to liquid crystal cells the different values of color levels correspond to different conversion reference voltage, and the correspondence relationship between the color level and the reference voltage is adjusted so that the display data with the same color level can reflect substantially the same displayed image on different liquid crystal panels, that is, a gamma curve is adjusted, where in order for a better display effect, the sub-pixels in the respective colors correspond to their respective gamma curves including different reference voltage values corresponding respectively to the display data with the different color levels. Thus in the prior art, in order to reflect objectively the consistency throughout the displayed image, the same color level in the sub-pixels in the same color corresponds to the same reference voltage, that is, there is only one gamma curve for the sub-pixels in the same color, where the gamma curve reflects different values of color levels corresponding to different reference voltage values, that is, each value of color value in the sub-pixels in a specific color corresponds to different one of the reference voltage values.

In order to address the influence of backward red and green light rays upon the colors of backlight in the adjacent backlight zones, and the inappropriate proportion of the red, green, and blue light in the white light in the target backlight zone arising from the backward red and green light rays in the adjacent backlight zones around the target backlight zone, which may come with an uncontrollable color of backlight in the target backlight zone, thus resulting in the problem of chromatic aberration in the target backlight zone, in this second embodiment, the backlight value in the target backlight zone is compared with the weighted average of the backlight values in the other backlight zones, and the reference voltage value corresponding to each value of color level for the display data is determined as a function of comparison, that is, given the same value of color level for the display data in the sub-pixels in the same color, there are different results of comparison made, and thus different reference voltage values determined, at different backlight brightness so that if the red and green light rays are compensated for using the different reference voltage values, then the proportion of the red, green, and blue light in the white light in the target backlight zone will vary.

The backlight value in the target backlight zone, and the weighted average of the backlight values in the other backlight zones can be determined, and the values of color levels for the display data in the sub-pixels in the display zone corresponding to the target backlight zone can be compensated for according to the result of comparing the backlight value in the target backlight zone with the backlight values in the other backlight zones, in the same way as the first embodiment, so a repeated description thereof will be omitted here; and the reference voltage generating section can generate the pixel voltage corresponding to the compensated values of color levels. In this second embodiment, given the same value of color level for the display data in the sub-pixels in the same color, the different reference voltage for digital to analog conversion can be determined according to the result of comparing the backlight value in the target backlight zone with the weighted average of the backlight values in the other backlight zones, and converted into the different pixel voltage values to drive the TFT data electrodes in the corresponding sub-pixel elements on the display panel to thereby alleviate the problem of chromatic aberration in the displayed image in the target display zone arising from the chromatic aberration of backlight.

The backlight comparing section can compensate for the values of color levels for the display data in the sub-pixels in the display zone corresponding to the target backlight zone according to the result of comparison in any one of the first approach to the third approach in the first embodiment, that is, the backlight comparing section can compensate for the values of color levels for the display data in the sub-pixels in the display zone corresponding to the target backlight zone by comparing the backlight value in the target backlight zone with the weighted average of the backlight values in the other backlight zones to thereby determine whether the former is more or less than the latter, or can compensate for the values of color levels for the display data in the sub-pixels in the display zone corresponding to the target backlight zone by determining the ratio of the backlight value in the target backlight zone to the weighted average of the backlight values in the other backlight zones, or can compensate for the values of color levels for the display data in the sub-pixels in the display zone corresponding to the target backlight zone according to a preset correspondence relationship between the backlight value in the target backlight zone, and the weighted average of the backlight values in the other backlight zones; and the backlight comparing section can generate the pixel voltage corresponding to the compensated values of color levels.

The backlight comparing section can compensate for the values of color levels for the display data in the sub-pixels in the display zone corresponding to the target backlight zone by comparing the backlight value in the target backlight zone with the weighted average of the backlight values in the other backlight zones to thereby determine whether the former is more or less than the latter, and generate the pixel voltage corresponding to the compensated values of color levels, particularly as follows: if the backlight value in the target backlight zone is more than the weighted average of the backlight values in the other backlight zones, then the reference voltage for digital to analog conversion for all the red and green sub-pixels in the display zone corresponding to the target backlight zone can be determined so that the pixel voltage values in all the red and green sub-pixels in the display zone are raised, or the reference voltage for digital to analog conversion for all the blue sub-pixels in the display zone corresponding to the target backlight zone can be determined so that the pixel voltage values in all the blue sub-pixels in the display zone are lowered; and If the backlight value in the target backlight zone is less than the weighted average of the backlight values in the other backlight zones, then the reference voltage for digital to analog conversion for all the red and green sub-pixels in the display zone corresponding to the target backlight zone can be determined so that the pixel voltage values in all the red and green sub-pixels in the display zone are lowered, or the reference voltage for digital to analog conversion for all the blue sub-pixels in the display zone corresponding to the target backlight zone can be determined so that the pixel voltage values in all the blue sub-pixels in the display zone are raised.

If the pixel voltage values in all the red and green sub-pixels in the target display zone are compensated for, then the pixel voltage values in all the red and green sub-pixels in the display zone will be compensated for by the same factor, and alike if the pixel voltage values in all the blue sub-pixels in the target display zone are compensated for, then the pixel voltage values in all the blue sub-pixels in the display zone will be compensated for by the same factor.

The backlight comparing section can compensate for the values of color levels for the display data in the sub-pixels in the display zone corresponding to the target backlight zone by determining the ratio of the backlight value in the target backlight zone to the weighted average of the backlight values in the other backlight zones particularly as follows: the difference between the backlight value in the target backlight zone, and the weighted average of the backlight values in the other backlight zones, and the ratio of the difference to the backlight value in the target backlight zone are determined, the products of a predetermined compensation factor corresponding to the ratio, and the values of color levels in the sub-pixels in the display zone corresponding to the target backlight zone are determined as values of color levels to be compensated for the display data in the sub-pixels in the display zone corresponding to the target backlight zone, and the determined values of color levels to be compensated are added to the values of color levels in the display zone corresponding to the target backlight zone; and the pixel voltage corresponding to the added-up values of color levels is generated.

The backlight comparing section can compensate for the values of color levels for the display data in the sub-pixels in the display zone corresponding to the target backlight zone according to a preset correspondence relationship between the backlight value in the target backlight zone, and the weighted average of the backlight values in the other backlight zones particularly as follows: a predetermined correspondence relationship table between the backlight value in the target backlight zone, the weighted average of the backlight values in the other backlight zones, and the compensation factor is searched for the compensation factor corresponding to the backlight value in the target backlight zone using the backlight value in the target backlight zone, and the weighted average of the backlight values in the other backlight zones, the products of the values of color levels in the sub-pixels in the display zone corresponding to the target backlight zone, and the determined compensation factor are determined as values of color levels to be compensated for the display data in the corresponding sub-pixels in the target display zone, and the determined values of color levels to be compensated are added to the values of color levels in the display zone corresponding to the target backlight zone; and the pixel voltage corresponding to the added-up values of color levels is generated.

Here the compensation factor can be determined by experimentally counting the influence of the backward red and green light rays generated in the backlight zones around the target backlight zone upon the brightness of backlight in the target backlight zone. Alternatively the compensation factor can be determined as a function of the ratio between the backlight value in the target backlight zone, and the weighted average of the backlight values in the other backlight zones, and the influence of the brightness of backlight in the other backlight zones around the target backlight zone upon the brightness of backlight in the target backlight zone.

Figure 11:
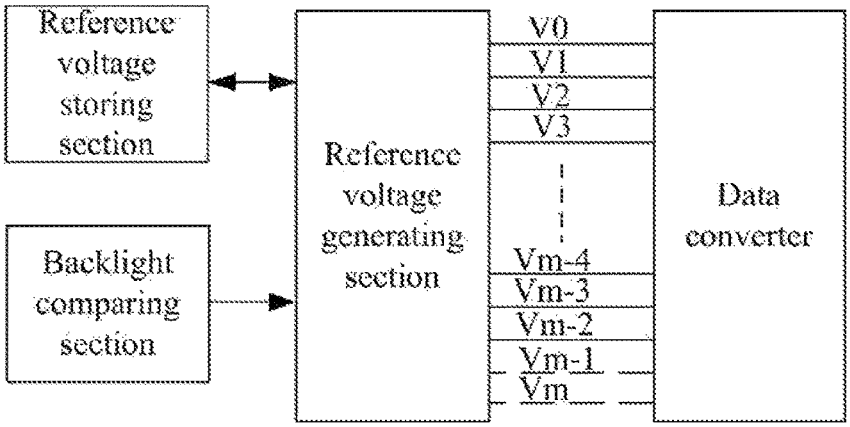
FIG. 11 illustrates a schematic diagram of a reference voltage generating section outputting reference voltage values according to the second embodiment of the application.

FIG. 11 illustrates a schematic diagram of a schematic diagram of the reference voltage generating section outputting the reference voltage values according to the second embodiment of the application, where the liquid crystal display device can further include a reference voltage storing section which can be included in the reference voltage generating section. As illustrated in FIG. 11, m different reference voltage values V0 to Vm are output, where the backlight comparing section is configured to generate a compensation result after the backlight value in the target backlight zone with the weighted average of the backlight values in the other backlight zones are compared, and the reference voltage generating section is configured to retrieve the reference voltage values corresponding to the values of color levels for the display data from the data table in the reference voltage storing section using the compensation result, to generate the corresponding reference voltage according to the retrieved reference voltage values, and to output the reference voltage to the digital to analog converter, so that the digital to analog converter converts the color level data into the corresponding pixel voltage.

Here there are a number of lookup tables in the reference voltage storing section, which include different lookup tables corresponding to the backlight values in the different backlight zones, and the weighted averages of the backlight values in the other backlight zones, where each lookup table corresponds to the reference voltage value corresponding to the different color level data.

Alternatively there can be different lookup tables corresponding respectively to the different ratios of the backlight value in the target backlight zone to the weighted average of the backlight values in the other backlight zones, where the number of lookup tables corresponding to the different ratios of the backlight value in the target backlight zone to the weighted average of the backlight values in the other backlight zones is less than the number of lookup tables corresponding to the backlight values in the different backlight zones, and the weighted averages of the backlight values in the other backlight zones.

In order to avoid the backward red and green light rays from influencing mixing of backlight in the adjacent backlight zones, the backward red and green light rays in the adjacent backlight zones will be adjusted with dynamic backlight control so that the backward red and green light may come with an inappropriate proportion of the red, green, and blue light in the white light in the target backlight zone, thus resulting in an uncontrollable color of backlight in the target backlight zone, and consequentially the problem of chromatic aberration in the target backlight zone, in this second embodiment, given the target display zone, the backlight value in the target backlight zone is compared with the weighted average of the backlight values in the other backlight zones, a different preset gamma curve is applied according to the result of comparison, and the conversion reference voltage for the respective sub-pixels in the target display zone is determined from the gamma curve, where the gamma curve is preset so that the pixel voltage values in the respective sub-pixels R (red), G (green), and B (blue) in the target display zone are compensated for, where the pixel voltage values can be adjusted to thereby alleviate the problem of chromatic aberration in the displayed image arising from the chromatic aberration of backlight caused by the backward light.

Third Embodiment

Figure 12:
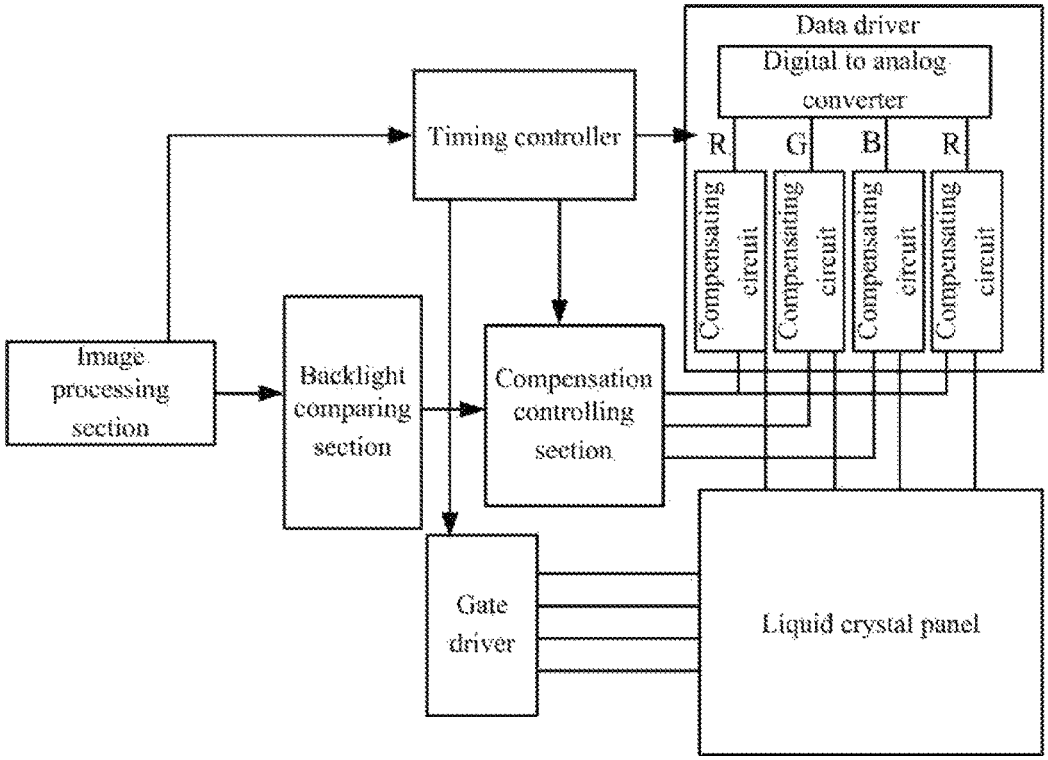
FIG. 12 illustrates a schematic structural diagram of a liquid crystal display device according to a third embodiment of the application.
Figure 13:
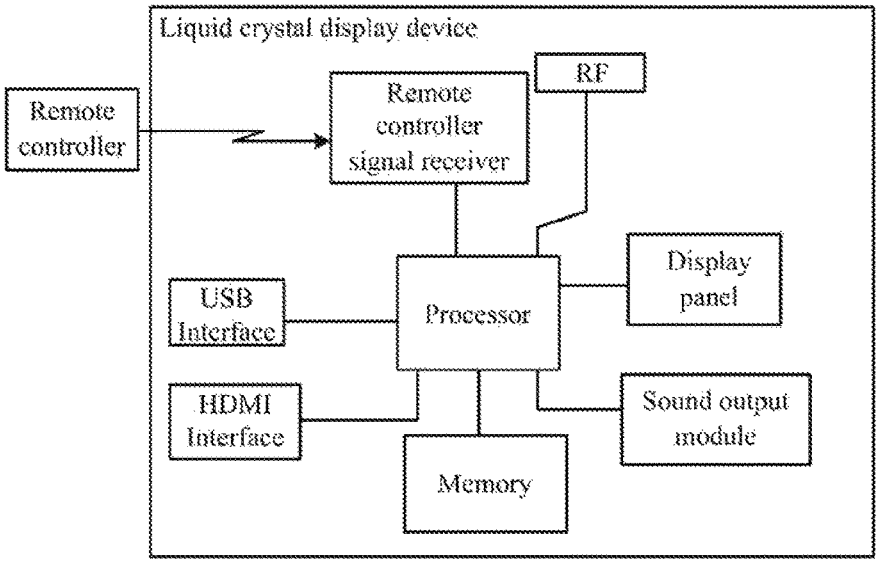
FIG. 13 illustrates a schematic structural diagram of a liquid crystal display device according to a fourth embodiment of the application.

Further to the second embodiment, as illustrated in FIG. 12, alternatively the backlight comparing section can determine the values of color values to be compensated for the display data in the sub-pixels in the display zone corresponding to the target backlight zone, and instead of the reference voltage generating section, a compensation controlling section can be configured to determine pixel voltage compensation values for the respective sub-pixels R (red), G (green), and B (blue) in the display zone corresponding to the target backlight zone according to the result of comparing the backlight values by the backlight comparing section, and compensating circuits can be configured to compensate the pixel voltage values in the respective sub-pixels in the display zone using the pixel voltage compensation values, so that the pixel voltage values can be adjusted to thereby alleviate the problem of chromatic aberration in the displayed image arising from the chromatic aberration of backlight caused by the backward light.

The backlight value in the target backlight zone, and the weighted average of the backlight values in the other backlight zones can be determined, and the values of color levels to be compensated for the display data in the sub-pixels in the display zone corresponding to the target backlight zone can be determined according to the result of comparing the backlight value in the target backlight zone with the backlight values in the other backlight zones, in the same way as the first embodiment, so a repeated description thereof will be omitted here.

Four Embodiment

Some embodiments provide a liquid crystal display device as illustrated in FIG. 4 including backlight sources provided by a direct-light-type backlight module, where a number of spot light sources 200 are arranged on an inner surface of a bottom board 704 of a back encapsulating structure 701 (backboard) of the backlight module, where the spot light sources 200 can be blue LED lamps; and a quantum dot material encapsulating section 702 is located in a light exit direction of the spot light sources 200, where in order to guarantee thermal isolation performance of a quantum dot material, and to sufficiently mix light emitted by the spot light sources 200, there will be some thermal isolation gap and light mixing distance between the quantum dot material encapsulating section 702 and the spot light sources 200, where the exciting light (e.g., blue light) emitted by the spot light sources 200 is sufficiently mixed into uniform exciting surface light sources; and then the exciting surface light sources excite the quantum dot material in the light exit direction to generate excited light so that the excited light is mixed into mixed light and/or the excited light is mixed into the transmitted exciting light into white light sources; and the quantum dot material is encapsulated in the quantum dot material encapsulating section 702, where the quantum dot material encapsulating section 702 can be composed of encapsulating quantum dots in the scattering board, can be composed of encapsulating quantum dots in an optical film sheet, or can be embodied in other encapsulating optical structures. In the liquid crystal display device operating with dynamic zoned back control, a displayed image is zoned in correspondence to zones of backlight sources, grayscale brightness of the image in the display zones is counted, and the values of grayscale brightness in the display zones of the image are converted into drive signals to drive the backlight sources, that is, if the average grayscale brightness in a display zone of the image is higher, then the grayscale brightness will be converted into a backlight drive signal to drive a backlight source in a backlight zone corresponding to the display zone at higher brightness.

As described above, in order to compensate for the pixel voltage values in the sub-pixels R (red), G (green), and B (blue) in the respective zones, the liquid crystal display device as illustrated includes a memory and at least one processor, where the memory stores therein instructions executable by the at least one processor are stored, and the instructions are configured to be executed by the at least one processor to cause the at least one processor to be capable of: obtaining backlight values in respective backlight zones as a function of values of grayscale brightness of a displayed image; and comparing the backlight value in a target backlight zone with the weighted average of the backlight values in the other backlight zones, and compensating for values of color levels for display data in sub-pixels in a display zone corresponding to the target backlight zone according to a result of comparison.

The backlight value in the target backlight zone, and the weighted average of the backlight values in the other backlight zones can be determined, and the values of color levels for the display data in the sub-pixels in the display zone corresponding to the target backlight zone can be compensated according to the result of comparing the backlight value in the target backlight zone with the backlight values in the other backlight zones, in the same way as the first embodiment, so a repeated description thereof will be omitted here; and the process is further capable of generating pixel voltage corresponding to the compensated values of color levels.

The liquid crystal display device can further include an input unit, an output unit, and other components. Those skilled in the art can appreciate that the liquid crystal display device will not be limited to the structure thereof illustrated in FIG. 12, but can include more or less components than those as illustrated, or some of the components as illustrated can be combined, or different components from those as illustrated can be arranged.

The memory can include a high-speed random access memory, and can further include a nonvolatile memory, e.g., at least one magnetic disc memory device, a flash memory device, or another volatile solid memory device. Moreover the memory can further include a memory controller configured to provide an access of the processor and the input unit to the memory.

The processor is a control center of the liquid crystal display device, has the respective components of the entire terminal connected by various interfaces and lines, and runs or executes software programs and/ore modules stored in the memory and invokes data stored in the memory to perform the various functions of the liquid crystal display device and process the data to thereby manage and control the liquid crystal display device as a whole. The processor can include one or more processing cores; and optionally the processor can be integrated with an application processor and a modem processor, where the application processor generally handles the operating system, the user interfaces, the applications, etc., and the modem processor generally handles wireless communication. As can be appreciated, the modem processor may not be integrated into the processor.

The liquid crystal display device can include a TV and radio receiver, a High-Definition Multimedia (HDMI) interface, a USB interface, an audio and video input interface, and other input units, and the input unit can further include a remote control receiver to receive a signal sent by a remote controller. Moreover the input unit can further include a touch sensitive surface and other input devices, where the touch sensitive surface can be embodied in various types of resistive, capacitive, infrared, surface sound wave and other types, and the other input devices can include but will not be limited to one or more of a physical keyboard, functional keys (e.g., a volume control button, a power-on or -off button, etc.), a track ball, a mouse, a joystick, etc.

The output unit is configured to output an audio signal, a video signal, an alert signal, a vibration signal, etc. The output unit can include a display panel, a sound output module, etc. The display panel can be configured to display information input by a user or information provided to the user, and various graphic user interfaces of the liquid crystal display device, where these graphic user interfaces can be composed of graphics, texts, icons, videos and any combination thereof. For example, the display panel can be embodied as a Liquid Crystal Display (LCD), an Organic Light-Emitting Diode (OLED), a flexible display, a 3D display, a CRT, a plasmas display panel, etc.

The liquid crystal display device can further include at least one sensor (not illustrated), e.g., an optical sensor, a motion sensor, and other sensors. Particularly the optical sensor can include an ambient optical sensor and a proximity sensor, where the ambient optical sensor can adjust the brightness of the display panel according to the luminosity of ambient light rays, and the proximity sensor can power off the display panel and/or a backlight when the liquid crystal display device moves to some position. The liquid crystal display device can be further configured with a gyroscope, a barometer, a hygrometer, a thermometer, an infrared sensor, and other sensors.

The liquid crystal display device can further include an audio circuit (not illustrated), and a speaker and a transducer can provide an audio interface between the user and the liquid crystal display device. The audio circuit can convert received audio data into an electric signal and transmit the electric signal to the speaker, which is converted by the speaker into an audio signal for output; and on the other hand, the transducer converts a collected audio signal into an electric signal which is received by the audio circuit and then converted into audio data, and the audio data is further output to the processor for processing and then transmitted to another display device, for example, or the audio data is output to the memory or further processing. The audio circuit may further include an earphone jack for communication between a peripheral earphone and the liquid crystal display device.

Moreover the liquid crystal display device can further include a Radio Frequency (RF) circuit. The RF circuit can be configured to receive and transmit a signal. Typically the RF circuit includes but will not be limited to an antenna, at least one amplifier, a tuner, one or more oscillators, a Subscriber Identifier Module (SIM) card, a transceiver, a coupler, a Low Noise Amplifier (LNA), a duplexer, etc. Moreover the liquid crystal display device can further include a web cam, a Bluetooth module, etc.

Moreover the liquid crystal display device further includes a Wireless Fidelity (WiFi) module (not illustrated). The WiFi is a technology of short-range wireless transmission, and the liquid crystal display device can assist the user in transmitting and receiving an email, browsing a web page, accessing streaming media, etc., and also provide the user with a wireless broadband access to the Internet, through the WiFi module. Although the WiFi module is illustrated in FIG. 12, it can be appreciated that the WiFi module may not necessarily be included in the liquid crystal display device but can be omitted as required without departing from the scope of the spirit of the application.

The foregoing disclosure is merely illustrative of the particular embodiments of the application, but the claimed scope of the application will not be limited thereto, and any variations or alternatives which can readily occur to those skilled in the art without departing from the scope of the application as disclosed here shall fall into the scope of the application as claimed which shall be as defined in the appended claims.

The invention claimed is:

1. An image processing method, applicable to a liquid crystal display device comprising a quantum dot component, a liquid crystal panel, a blue light source configured to emit a blue light to excite the quantum dot component to provide backlight for the liquid crystal panel, a plurality of display zones, and a backlight sources matrix divided into a plurality of backlight zones according to positions of backlight sources, each of the plurality of backlight zones mapped to corresponding one of the plurality of display zones, wherein the method comprises:

obtaining, by the liquid crystal display device, backlight values in respective backlight zones according to values of grayscale brightness of a displayed image; and comparing, by the liquid crystal display device, a backlight value in a target backlight zone with a weighted average of backlight values in at least one backlight zone adjacent to the target backlight zone, and according to a result of comparison, in response to determining that the backlight value in the target backlight zone is more than the weighted average of the backlight values in at least one backlight zone adjacent to the target backlight zone, raising values of color levels in all red sub-pixels and green sub-pixels in a display zone corresponding to the target backlight zone at a same time.

2. The image processing method according to claim 1, wherein the method comprises raising the values of color levels in all the red sub-pixels and the green sub-pixels in the display zone corresponding to the target backlight zone by a same factor.

3. The image processing method according to claim 1, wherein in response to determining that the backlight value in the target backlight zone is more than the weighted average of the backlight values in at least one backlight zone adjacent to the target backlight zone the method further comprises lowering the values of color levels in all blue sub-pixels in the display zone corresponding to the target backlight zone.

4. The image processing method according to claim 1, wherein weight coefficients of weighted backlight values in at least one backlight zone adjacent to the target backlight zone are determined according to distances of at least one backlight zone adjacent to the target backlight zone from the target backlight zone, wherein there is a smaller weight coefficient of a backlight zone at a longer distance from the target backlight zone, and there is a larger weight coefficient of a backlight zone at a shorter distance from the backlight display zone.

5. The image processing method according to claim 1, wherein the method further comprises:

determining compensation voltage values corresponding to the values of color levels as raised; and driving sub-pixels in the display zone corresponding to the target backlight zone using the compensation voltage values.

6. A liquid crystal display device, the device comprising:

a quantum dot component;

a liquid crystal panel;

a blue light source configured to emit a blue light to excite the quantum dot component to provide backlight for the liquid crystal panel;

a plurality of display zones;

a backlight sources matrix divided into a plurality of backlight zones according to positions of backlight sources, each of the plurality of backlight zones is mapped to corresponding one of the plurality of display zones;

a timing controller configured to receive externally input displayed image data, and to extract a timing signal and an image data signal;

a gate driving circuit configured to receive the timing signal to drive gate scanning;

a data driving circuit configured to receive the timing signal and the image data signal to drive data electrodes for data scanning, wherein the data driving circuit digital-to-analog converts the image data signal into pixel voltage values configured to drive TFT data electrodes in sub-pixels respectively;

a backlight comparing section configured to compare a backlight value in a target backlight zone with a weighted average of backlight values in at least one backlight zone adjacent to the target backlight zone and according to a result of comparison, to perform at least one of following operations:

in response to determining that the backlight value in the target backlight zone is more than the weighted average of the backlight values in at least one backlight zone adjacent to the target backlight zone, raising values of color levels in all red sub-pixels and green sub-pixels in a display zone corresponding to the target backlight zone at a same time; or in response to determining that the backlight value in the target backlight zone is less than the weighted average of the backlight values in at least one backlight zone adjacent to the target backlight zone, lowering the values of color levels in all the red sub-pixels and the green sub-pixels in the display zone corresponding to the target backlight zone at the same time; and a reference voltage generating section configured to generate pixel voltage corresponding to values of color levels as raised or the values of the color levels as lowered.

7. The liquid crystal display device according to claim 6, wherein the backlight comparing section is further configured to:

raise the values of color levels in all the red sub-pixels and the green sub-pixels in the display zone corresponding to the target backlight zone by a first factor; or lower the values of color levels in all the red sub-pixels and the green sub-pixels in the display zone corresponding to the target backlight zone by a second factor.

8. The liquid crystal display device according to claim 6, wherein the backlight comparing section is further configured:

in response to determining that the backlight value in the target backlight zone is more than the weighted average of the backlight values in at least one backlight zone adjacent to the target backlight zone, to lower values of color levels in all blue sub-pixels in the display zone corresponding to the target backlight zone; or in response to determining that the backlight value in the target backlight zone is less than the weighted average of the backlight values in at least one backlight zone adjacent to the target backlight zone, to raise the values of color levels in all the blue sub-pixels in the display zone corresponding to the target backlight zone.

9. The liquid crystal display device according to claim 6, wherein the backlight comparing section is configured to determine weight coefficients of weighted backlight values in at least one backlight zone adjacent to the target backlight zone according to distances of at least one backlight zone adjacent to the target backlight zone from the target backlight zone, wherein there is a smaller weight coefficient of a backlight zone at a longer distance from the target backlight zone, and there is a larger weight coefficient of a backlight zone at a shorter distance from the target backlight zone.

10. The liquid crystal display device according to claim 6, wherein the reference voltage generating section configured to generate the pixel voltage corresponding to the values of color levels as raised or the values of color levels as lowered is further configured to determine compensation voltage values corresponding to the values of color levels as raised or the values of color levels as lowered according to a gamma curve.

11. An image processing method, applicable to a liquid crystal display device comprising a quantum dot component, a liquid crystal panel, a blue light source configured to emit a blue light to excite the quantum dot component to provide backlight for the liquid crystal panel, a plurality of display zones, and a backlight sources matrix divided into a plurality of backlight zones according to positions of backlight sources, each of the plurality of backlight zones is mapped to corresponding one of the display zones, wherein the method comprises:

obtaining, by the liquid crystal display device, backlight values in respective backlight zones according to values of grayscale brightness of a displayed image;

comparing, by the liquid crystal display device, a backlight value in a target backlight zone with a weighted average of backlight values in at least one backlight zone adjacent to the target backlight zone; and according to a result of comparison, in response to determining that the backlight value in the target backlight zone is less than the weighted average of the backlight values in at least one backlight zone adjacent to the target backlight zone, lowering values of color levels in all red sub-pixels and green sub-pixels in a display zone corresponding to the target backlight zone at a same time.

12. The image processing method according to claim 11, wherein the method further comprises lowering the values of color levels in all the red sub-pixels and the green sub-pixels in the display zone corresponding to the target backlight zone by a same factor.

13. The image processing method according to claim 11, wherein in response to determining that the backlight value in the target backlight zone is less than the weighted average of the backlight values in at least one backlight zone adjacent to the target backlight zone among the plurality of backlight zones, the method further comprises raising the values of color levels in all blue sub-pixels in the display zone corresponding to the target backlight zone.

14. The image processing method according to claim 11, wherein weight coefficients of weighted backlight values in at least one backlight zone adjacent to the target backlight zone are determined according to distances of at least one backlight zone adjacent to the target backlight zone from the target backlight zone, wherein there is a smaller weight coefficient of a backlight zone at a longer distance from the target backlight zone, and there is a larger weight coefficient of a backlight zone at a shorter distance from the target backlight zone.

15. The image processing method according to claim 11, wherein the method further comprises:

determining compensation voltage values corresponding to the values of color levels as lowered; and driving sub-pixels in the display zone corresponding to the target backlight zone using the compensation voltage values.

* * * * *